United States Patent [19]

Gau

[11] Patent Number: 5,052,085

[45] Date of Patent: Oct. 1, 1991

[54] STRUCTURE OF CLOTHES CLIP

[76] Inventor: Shwu-Jing Gau, 2 Fl., No. 24, Ming-Chuan 1 St. Chu-Wei Li, Pan-Shui Cheng, Taipei, Hsien, Taiwan

[21] Appl. No.: 501,704

[22] Filed: Mar. 30, 1990

[51] Int. Cl.[5] ..... A44B 21/00

[52] U.S. Cl. ..... 24/501; 24/511

[58] Field of Search ..... 24/511, 509, 508, 507, 24/501, 500; 223/91, 93, 96

[56] References Cited

U.S. PATENT DOCUMENTS

| | | | |
|---|---|---|---|
| 2,461,333 | 2/1949 | Maccaferri | 24/511 X |
| 2,471,606 | 5/1949 | Burns | 24/511 X |
| 2,583,784 | 1/1952 | Maccaferri | 223/91 |
| 4,660,750 | 4/1987 | Blanchard | 24/501 X |
| 4,878,276 | 11/1989 | Morrish et al. | 24/511 |

FOREIGN PATENT DOCUMENTS

| | | | |
|---|---|---|---|
| 143506 | 9/1950 | United Kingdom | 24/511 |

*Primary Examiner*—James R. Brittain

*Attorney, Agent, or Firm*—Lowe, Price, LeBlanc & Becker

[57] ABSTRACT

A clothes clip, which comprises two opposite clamping members pivotally retained by a substantially U-shaped spring which bilaterally equivalently presses on the two opposite clamping members. The two opposite clamping members have two pair of parallel pivots respectively made thereon permitting one pair of parallel pivots to releasably engage with the opposite pair, and two opposite rows of guide rods alternatively engaged with one another to form a stopping structure for securing the clothes clip on the transverse rod of a clothes hanger permitting the clothes clip to move therealong.

1 Claim, 8 Drawing Sheets

STRUCTURE OF CLOTHES CLIP

BACKGROUND OF THE INVENTION

The present invention is related to clips and more particularly to a clip for holding clothes.

The clothes hanger is a small frame on which a garment is hung to keep it in shape and the clothes clip is a device for holding a garment. Recently, clothes clips have been common used to combine with clothes hangers for holding garments. It is indeed very practical in use to combine clothes clips with a garment hanger for holding clothes. However, it requires some special design or technique to incorporated a clothes clip with a clothes hanger.

FIG. 1 illustrates a kind of clothes clip which utilizes a spring to retain two opposite parts together for clipping things. During mounting on a clothes hanger, the transvers rod (3) of the clothes hanger is inserted through the space between the spring (S) and the two opposite pivots (C) of the clothes clip permitting the clothes clip to be hung thereon. Because the spring (S) directly supports the downward gravity of a garment which is clipped by the clothes clip, the garment will drop from the clothes clip if the downward pulling force of the load of the garment surpasses the clipping strength of the clothes clip. Even if the clipping strength of the clothes clip is strong enough to support the downward pulling force of the load of the garment, the garment still can not be firmly retained on the clothes hanger and may be easily forced to swing by wind force.

FIG. 2 illustrates another kind of clothes clip which can be fixedly secured to the transverse rod a clothes hanger. During mounting on the transverse rod 3 of a clothes hanger, the transverse rod 3 of the clothes hanger is inserted through the two sode pivots of the two opposite parts (1) and (2) and the spring (S) to firmly retain the spring (S) and the two opposite parts (1) and (2) of the clothes clip together, permitting the two opposite ends of the spring (S) to respectively stop against the inner upper portions of the two opposite parts (1) and (2) respectively. Although the clothes clip can be fixedly secured to the transverse rod 3 of the clothes hanger, the mounting process is complicated and time consuming. This design is not suitable for mass production. The disadvantages of the aforesaid clothes hanger and clip combination set are outlined hereinafter:

1. The both ends of the transverse rod (3) can not be bent vertically upward (see A, A' in FIG. 3) before the mounting of a clothes clip, or a clothes clip will be difficult to mount on the transverse rod (3).

2. The mounting process is time consuming and it is rather difficult to bend the both ends of the transverse rod (3) after a clothes clip has been mounted thereon. As a consequence, the manufacturing cost is relatively increased.

3. The two opposite parts of a clothes clip may be easily deviated from each other to affect its clipping effect (as shown in the dotted line of FIG. 2) since the both ends of the spring (S) thereof are difficult to accurately equivalently press on the inner upper portions of the two opposite parts.

4. The transverse rod (3) of a clothes hanger is generally made of metal material and covered with a plastic sleeve for protection, which plastic sleeve may be easily rub to tear. Thus, the metal transverse rod (3) may gather rust easily due to direct conact with the air.

5. Because the spring (S) of a clothes clip is directly mounted on the transverse rode (3) of a clothes hanger, it is very difficult to move a clothes clip along the transverse rod (3) for position change, or the plastic sleeve of the transverse rod (3) may be torn up by a clothes clip if to move a clothes clip by force.

SUMMARY OF THE INVENTION

The present invention has been accomplished under the circumstances in view. It is an object of the present invention is to provide a clothes clip which is easy to mount on a clothes hanger directly without the use of any tools, can firmly secure a load to a clothes hanger and can be conveniently moved on the transverse rod of a clothes hanger for position change.

To accomplish the above object, a clothes clip in accordance with the present invention comprises two opposite clamping members retained by a substantially U-shaped spring to pivot against each other for clamping things. The two clamping members are identical and respectively made of a substantially rectangular plate having two opposite sides, one of which is a flat surface having an elongated slot longitudinally piercing therethrough to the opposite side and an embossed thread or grip portion on its upper part for holding of fingers and with a hole made thereon; the other of which comprises a toothed portion on its lower part, two parallel pivots transversely disposed above the toothed portion, the left one of the two parallel pivots has a semi-circular projecting key on its front end and the right one of the two parallel pivots has a semi-circular recess on its front end, and a row of guide rods transversely disposed above the two parallel pivots. By means of the arrangement of the guide rods, the clip can firmly secured to the transverse rod of a clothes hanger for holding a garment. The distance between the parallel pivots and the guide rods is properly designed according to the outer diameter of the transverse rod (including its plastic shield) of a clothes hanger to mount so that the clothes clip can be conveniently moved along the transverse rod of such a clothes hanger for position change.

DETAILED DESCRIPTION OF THE PREFERRED EMBODIMENTS

Figure 1:
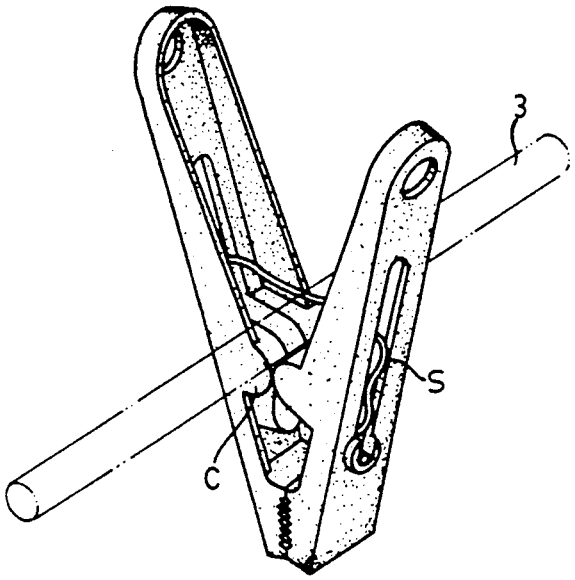
FIG. 1 PRIOR ART
FIG. 1 illustrates a clothes clip according to the prior art.
Figure 2:
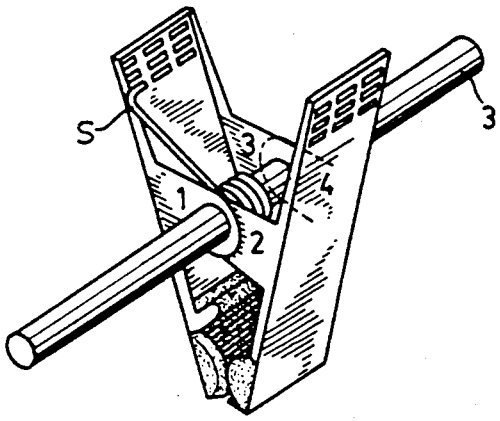
FIG. 2 PRIOR ART
FIG. 2 illustrates another design of clothes clip according to the prior art.
Figure 3:
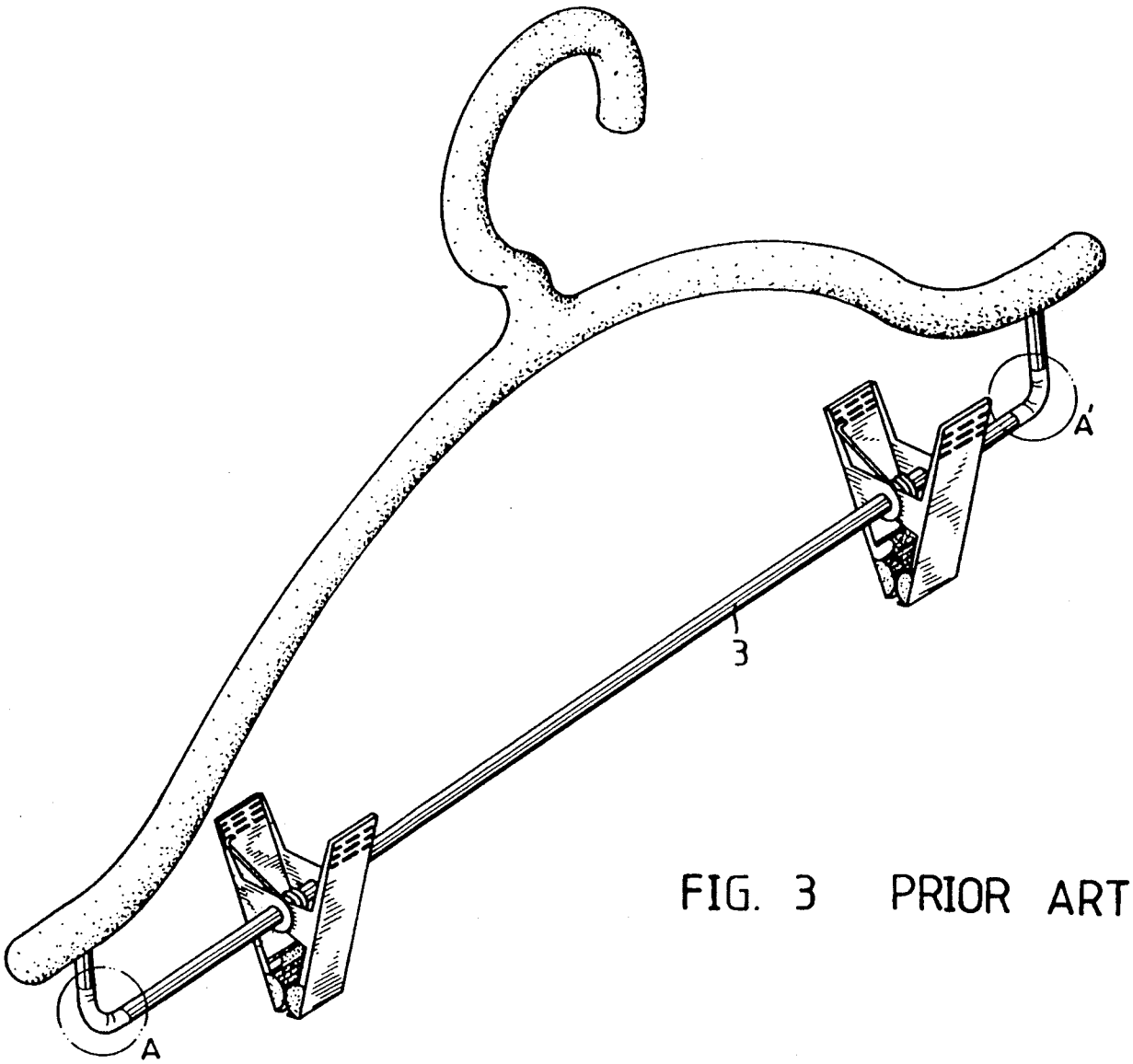
FIG. 3 PRIOR ART
FIG. 3 illlustrates a clothes hanger having mounted thereon two clothes clips of the prior art.
Figure 4:
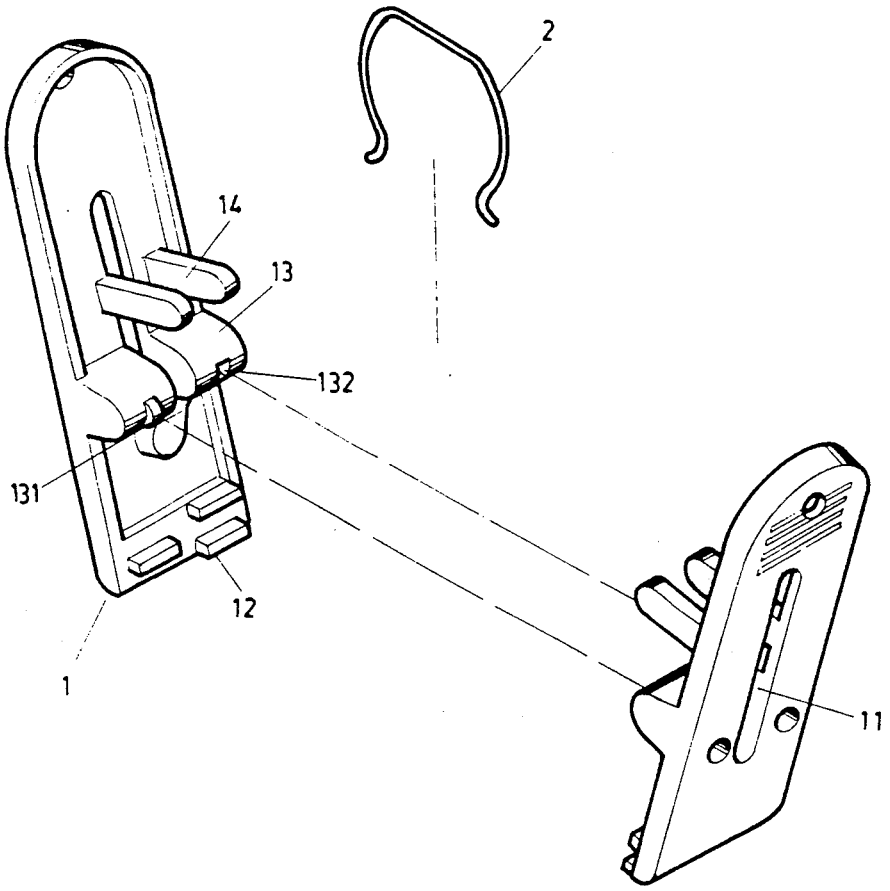
FIG. 4 is a perspective fragmentary view of a clothes clip according to the present invention.

Referring to FIG. 4, therein illustrated is a clothes clip in accordance with the present invention which is generally comprised of two identical clamping members 1 oppositely retained by a substantially U-shaped spring 2. A clamping member 1 according to the present invention is substantially a rectangular plate having two opposite sides, one of which is a flat surface having an elongated slot 11 longitudinally piercing therethrough to the opposite side and an embossed thread or grip portion 15 on its upper part with a hole 151 made thereon; the other of which comprises a toothed portion 12 on its lower part, two parallel pivots 13 transversely above the toothed portion 12 the left pivot of which has a semi-circular projecting key 131 on its front end and the right pivot of which has a semi-circular recess 132 on its front end, a rods of guide row 14 transversely above the two parallel pivots 13. The distance between the parallel pivots 13 and the guide rods 14 is properly designed according to the outer diameter of the transverse rod 3 (including its plastic shield) of a clothes hanger.

Figure 5:
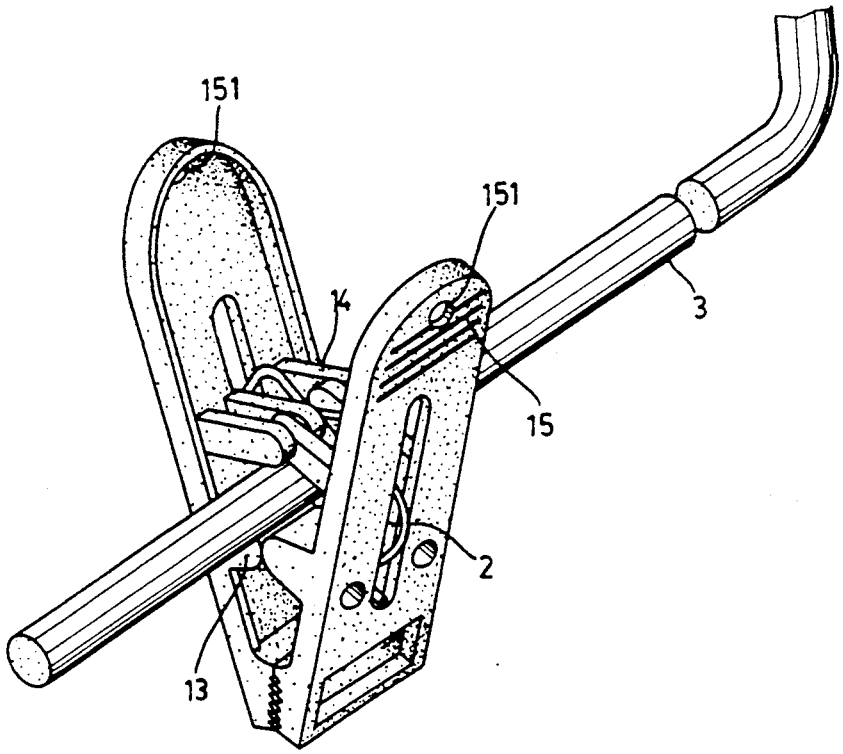
FIG. 5 illustrates the positioning of a clothes clip of the present invention on the transverse rod of a clothes hanger.
Figure 6:
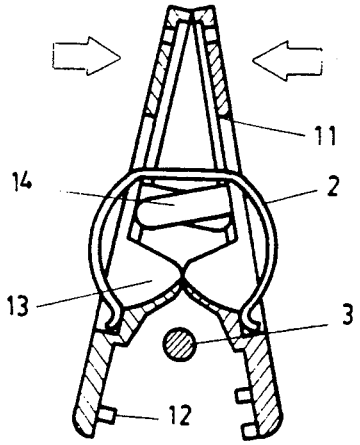
FIGS. 6 through 8 are schematic drawings, illustrating the process to mount a clothes clip of the present invention on the transverse rod of a clothes hanger.
Figure 7:
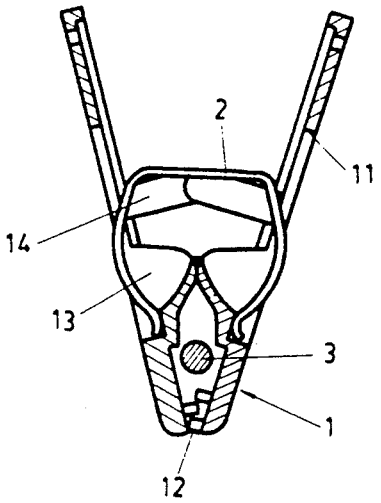
Figure 8:
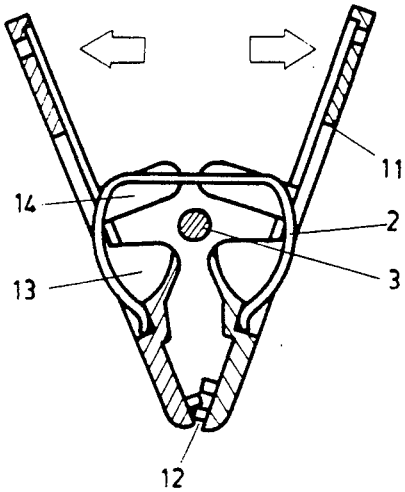
Figure 9:
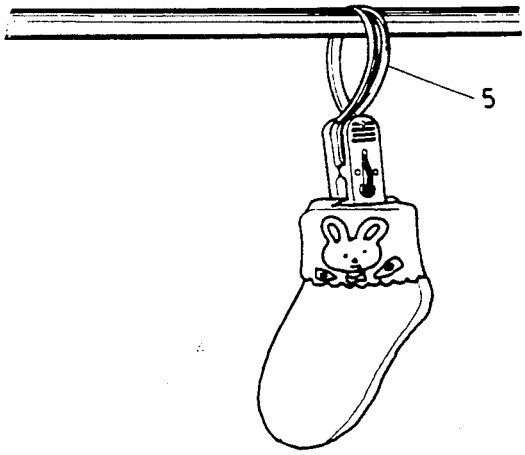
FIGS. 9 through 12 are schematic drawings, illustrating various types of clothes hangers with combined clothes clips according to the present invention.

FIG. 5 illustrates the positioning of the aforesaid embodiment of clothes clip on the transverse rod 3 of a clothes hanger. The mounting procedure is outlined hereinafter with reference to FIGS. 6 through 8. Squeeze the two embossed thread or grip portions 15 of the two opposite clamping members 1 inward to separate the toothed portions 12 thereof to open for the setting therein of the transverse rod 3 of a clothes hanger. After the transverse rod 3 of such a clothes hanger is set in between the two toothed portions 12 of the two opposite clamping members 1, release the squeezing force from the two embossed thread portions 15 of the two opposite clamping members 1 permitting the clothes clip to return to original position (as shown in FIG. 7). Thus, the transverse rod 3 of the clothes hanger becomes retained in the clothes clip above the two toothed portions 12. Then, pull the two embossed thread or grip portions 15 of the two opposite clamping members 1 bilaterally outward to separate the two parallel pivots 13 of one clamping member 1 from the two parallel pivots 13 of the other clamping member 1 so that a gap is left between the two pairs of parallel pivots 13 (see FIG. 8) for the passing therethrough of the transverse rod 3 to get in the space between the parallel pivots 13 and the upper guide rods 14. After the transverse rod 3 is set in the space between the parallel pivots 13 and the guide rods 14, the outward pulling force is released from the two embossed thread portions 15 permitting the clip to return to original position. Thus, the transverse rod 3 becomes retained in the clip between the parallel pivots 13 and the guide rods 14 as shown in FIG. 5. The clothes clip may be independently used without matching with a clothes hanger. As shown in FIG. 9, a hanging cord 5 is inserted through the holes 151 of the two embossed thread or grip portions 15 of the two opposite clamping members 1 to hang the clothes clip on a rod for holding stockings or other things. Therefore, the clothes clip can be separately packed and a consumer can combine the clothes clip with a clothes hanger by oneself. Because of the design of substantially U-shaped configuration, the spring 2 is equivalently pressing against the two opposite clamping members 1. Further, because of the arrangement of the guide rods 14 of two opposite clamping members 1 which are alternatively engaged with one another when the clothes clip is in an engaged position, the two opposite clamping members 1 are protected against deviation from each other. Another effect of the guide rods 14 of the two opposite clamping members 1 is to form a stopping structure to firmly secure the clothes clip to the transverse rod of a clothes hanger for supporting a heavy load when the clothes clip clamps up a heavy garment. Another feature of the present invention is that the distance between the parallel pivots 13 and the guide rods 14 is properly designed according to the outer diameter of the transverse rod 3 of a clothes hanger so that the clothes clip can be conveniently moved along the transverse rod 3 when it is mounted thereon.

As described above, the present invention can provide various advantages including:

1. Because the clothes clip can be conveniently mounted on the transverse rod 3 of a clothes hanger it can be separately packaged. A consumer can buy the clothes clip separately in quantity according to one's requirement for flexible application.

Figure 10:
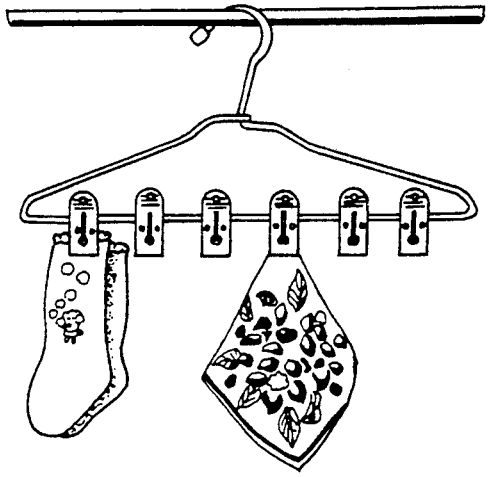
Figure 11:
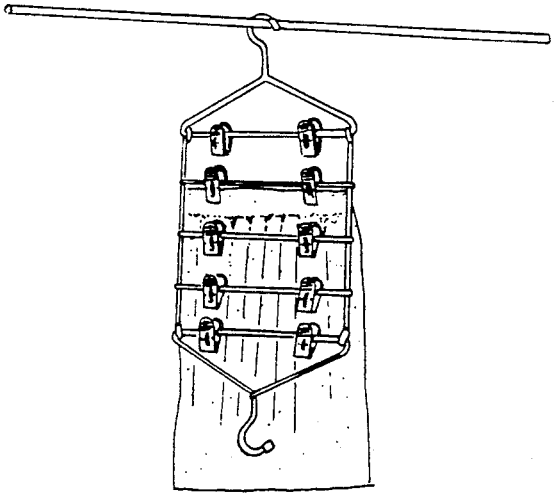
Figure 12:
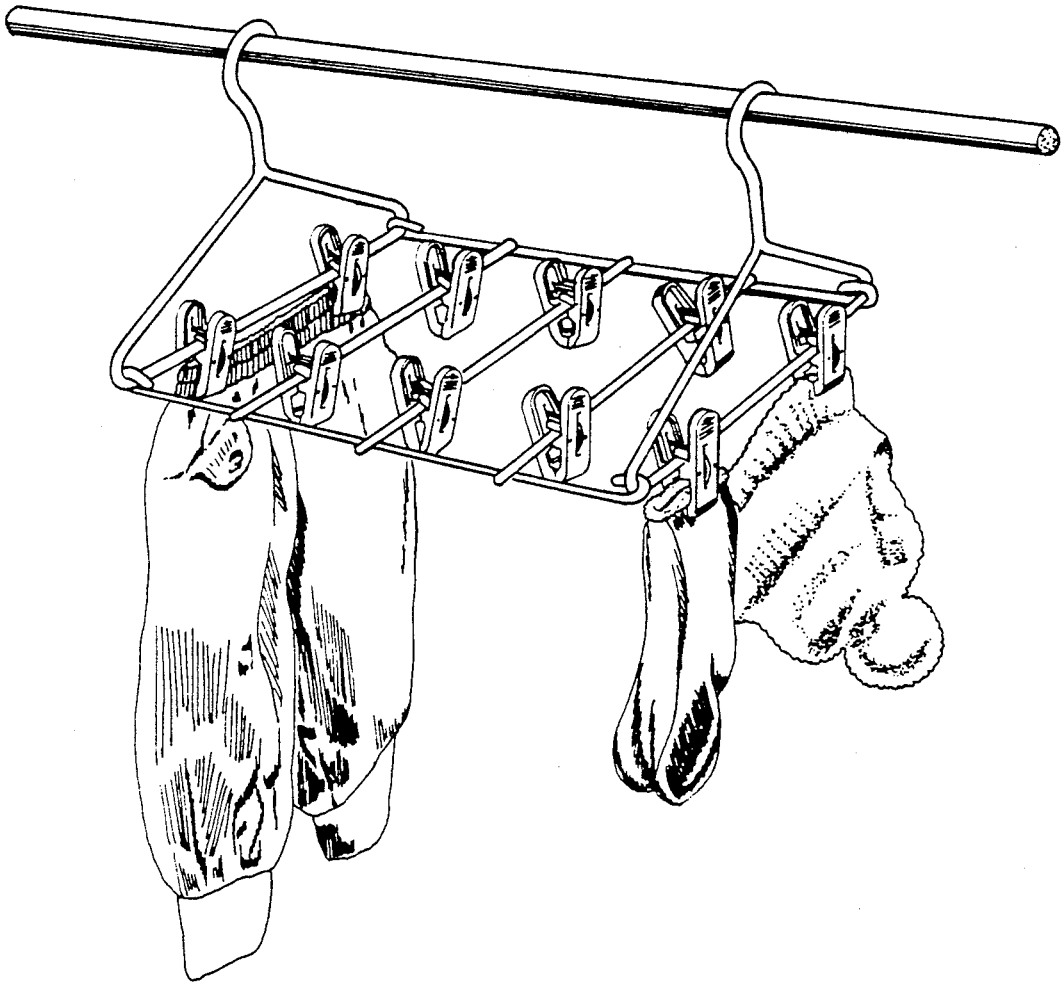

2. The clothes clip of the present invention can be separately used or flexibly used to match with a variety of clothes hangers (see FIGS. 10 through 12) according to purposes.

3. Because of the design of the u-shaped spring to equivalently press on the two opposite clamping members and because of the arrangement of the guide rods of the two opposite clamping members to alternatively engage with one another, the two opposite clamping members are protect against deviation from each other.

4. Because of the arrangement of the distance between the parallel pivots 13 and the guide rods 14, the clothes clip of the present invention can be conveniently moved along the transverse rod 3 of a clothes hanger for position change when it is mounted thereon.

5. Because of the arrangement of the guide rods of the two opposite clamping members to alternatively engage with one another, the clothes clip of the present invention can be firmly secured to the transverse rod of a clothes hanger for holding a heavy load of garment.

I claim:

1. A clothes clip, comprising two opposite clamping members retained by a substantially U-shaped spring to pivot against each other, said two clamping members being each a rectangular plate having two opposite sides, one of which being a flat surface having an elongated slot longitudinally piercing therethrough to the opposite side and an embossed grip portion on its upper part and having a hole therethrough; the other of which comprising a toothed portion on its lower part, two parallel pivots transversely disposed above said toothed portion, the left one of said two parallel pivots having a semi-circular projecting key on its front end and the right one of said two parallel pivots having a semi-circular recess on its front end, and a pair of guide rods transversely disposed on said member and spaced above said two parallel pivots a predetermined distance;

the distance between said parallel pivots and said guide rods being sufficient to receive the outer diameter of the transverse rod of a clothes hanger to mount, and the semi-circular projecting key and semi-circular recess of the two parallel pivots of one clamping member are releasably engaged with the semi-circular recess and semi-circular projecting key of the two parallel pivots of the opposite clamping member, the pair of guide rods of one clamping member extending inwardly and beyond the guide rods of the opposite clamping member so as to cross said U-shaped spring received in the respective slots to assemble said clip whereby when a transverse rod extends through said clip between said guide rods and pivots as said clip is opened and closed, said members pivot on said pivots.

* * * * *